US011437176B2

(12) United States Patent
Shibuya et al.

(10) Patent No.: US 11,437,176 B2
(45) Date of Patent: Sep. 6, 2022

(54) ELECTRONIC PASSIVE COMPONENT HAVING MARKING AREA FOR TRACING PRODUCTION HISTORY

(71) Applicant: TAIYO YUDEN CO., LTD., Tokyo (JP)

(72) Inventors: Yuji Shibuya, Takasaki (JP); Kazuhiko Otsuka, Takasaki (JP); Tetsuya Oga, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 42 days.

(21) Appl. No.: 16/908,410

(22) Filed: Jun. 22, 2020

(65) Prior Publication Data

US 2020/0350110 A1 Nov. 5, 2020

Related U.S. Application Data

(62) Division of application No. 15/713,380, filed on Sep. 22, 2017, now Pat. No. 10,748,696.

(30) Foreign Application Priority Data

Sep. 30, 2016 (JP) ..... JP2016-193536

(51) Int. Cl.

| | |
|---|---|
| ***H01F 27/00*** | (2006.01) |
| ***H01F 27/255*** | (2006.01) |
| ***H01F 27/29*** | (2006.01) |
| ***H01F 27/28*** | (2006.01) |
| ***H01F 41/02*** | (2006.01) |
| ***H01F 17/04*** | (2006.01) |

(52) U.S. Cl.

CPC ..... *H01F 27/255* (2013.01); *H01F 17/045* (2013.01); *H01F 27/00* (2013.01); *H01F 27/2823* (2013.01); *H01F 27/29* (2013.01); *H01F 41/02* (2013.01)

(58) Field of Classification Search

CPC ..... H01F 27/255; H01F 27/00; H01F 17/045; H01F 27/29; H01F 27/2823; H01F 41/02

See application file for complete search history.

(56) References Cited

U.S. PATENT DOCUMENTS

| | | | | |
|---|---|---|---|---|
| 2005/0096874 | A1 | 5/2005 | Smiley et al. | |
| 2014/0200843 | A1 | 7/2014 | Shamir et al. | |
| 2016/0276086 | A1* | 9/2016 | Quilici | H05K 1/0284 |

FOREIGN PATENT DOCUMENTS

| | | | |
|---|---|---|---|
| CN | 104332299 | A * | 2/2015 |
| JP | 2009088224 | A | 4/2009 |

(Continued)

OTHER PUBLICATIONS

Ex Parte Quayle Action issued by U.S. Patent and Trademark Office, dated Feb. 5, 2020, for U.S. Appl. No. 15/713,380 (9 pages).

(Continued)

*Primary Examiner* — Tuyen T Nguyen

(74) *Attorney, Agent, or Firm* — Law Office of Katsuhiro Arai

(57) ABSTRACT

An electronic component includes a member with marking having at least one marking area to be processed digitally, as well as a member other than the member with marking. The marking allows for tracing the production history of individual electronic components.

16 Claims, 12 Drawing Sheets

(56) References Cited

FOREIGN PATENT DOCUMENTS

| | | | | |
|---|---|---|---|---|
| JP | 2010021591 | A | | 1/2010 |
| KR | 20020040263 | A | * | 5/2002 |
| KR | 101349657 | B1 | | 1/2014 |

OTHER PUBLICATIONS

Notice of Allowance issued by U.S. Patent and Trademark Office, dated Jun. 12, 2020, for U.S. Appl. No. 15/713,380 (8 pages).
Restriction Requirement issued by U.S. Patent and Trademark Office, dated Jul. 25, 2019, for U.S. Appl. No. 15/713,380 (5 pages).

* cited by examiner

ELECTRONIC PASSIVE COMPONENT HAVING MARKING AREA FOR TRACING PRODUCTION HISTORY

CROSS-REFERENCE TO RELATED APPLICATIONS

This application is a divisional of U.S. patent application Ser. No. 15/713,380, filed Sep. 22, 2017, which claims priority to Japanese Patent Application No. 2016-193536, filed Sep. 30, 2016, each disclosure of which is incorporated herein by reference in its entirety including any and all particular combinations of the features disclosed therein. The applicant herein explicitly rescinds and retracts any prior disclaimers or disavowals or any amendment/statement otherwise limiting claim scope made in any parent, child or related prosecution history with regard to any subject matter supported by the present application.

BACKGROUND

Field of the Invention

The present invention relates to an electronic component, a method for manufacturing such electronic component, and an apparatus for manufacturing such electronic component, and specifically to, among other types of electronic components, an electronic component having a marking area for identifying the individual component, a method for manufacturing such electronic component, and an apparatus for manufacturing such electronic component, and more specifically to a passive component among other types of electronic components.

Description of the Related Art

Under prior art, on each general electronic component, marking a model number of the electronic component, marking a capacitance or other value for identifying the performance of the electronic component, and providing a marking to identify the orientation, etc., of the electronic component when it is mounted, are implemented, for example. As a result, mixing-in of wrong electronic components, mix-up of electronic components of different model numbers, and mounting of electronic components in incorrect orientations, are prevented. In Patent Literature 1, for example, a marking is provided on a multilayer inductor to indicate the position of each leader conductor. In Patent Literature 2, for example, markings are provided on a coil component to indicate the inductance and the start of winding.

In recent years, prior art includes marking on each electronic component a number for controlling the component history based on its lot, or specifically a lot number. In many cases, this is implemented by marking the lot number on the packing bag or taping reel. This way, the production history of electronic components in each lot becomes clear. On the coil component 1 based on prior art as illustrated schematically in FIG. 11, for example, its inductance marking 11, lot number 12, and polarity marking 13 are provided, to indicate the inductance of the coil component 1, the lot to which the coil component 1 belongs, and the starting position and direction of winding of the conductor constituting the coil component 1.

BACKGROUND ART LITERATURES

[Patent Literature 1] Japanese Patent Laid-open No. 2010-021591

[Patent Literature 2] Japanese Patent Laid-open No. 2009-088224

SUMMARY

According to prior art, the only thing that is clear is that a certain electronic component belonged to a given lot, and the production history of individual electronic components in a preceding or subsequent step cannot be traced. In the event that a defective electronic component is found, for example, the production history of the entire lot to which the applicable electronic component belongs can be traced in order to identify the cause of the defect; however, the production history of individual electronic components cannot be traced. For this reason, analyzing the electronic components in the same lot does not always result in an identification of the cause of the defect.

To solve the aforementioned problem, an object of the present invention is to provide an electronic component having a marking area for identifying the individual electronic component, not its lot, as well as a method for manufacturing such electronic component, and an apparatus for manufacturing such electronic component, in order to allow for tracing of the production history of individual electronic components.

Any discussion of problems and solutions involved in the related art has been included in this disclosure solely for the purposes of providing a context for the present invention, and should not be taken as an admission that any or all of the discussion were known at the time the invention was made.

The electronic component proposed by the present invention is characterized in that it comprises a member with marking area having at least one marking area to be processed digitally, as well as a member other than the member with marking area.

According to the present invention, tracing of production history becomes possible for each individual electronic component, not for each lot. By recording the marking area provided on each individual component as the electronic component passes through each of the production steps, the applicable machining conditions in each production step and other data can be recorded. Then, if the electronic component is found defective, the production history of the electronic component can be traced based on the data recorded in the marking area, to reveal the cause of the defect in a quick, accurate manner. The recorded data can also be applied to develop countermeasures to prevent the problem from occurring. In addition, the production history of an electronic component in all steps can be compiled, so that the machining conditions of the component in the production steps can be modified to more appropriate conditions based on the accumulated production history, thereby utilizing the information to improve productivity or as feedback to the next design stage, or the like.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
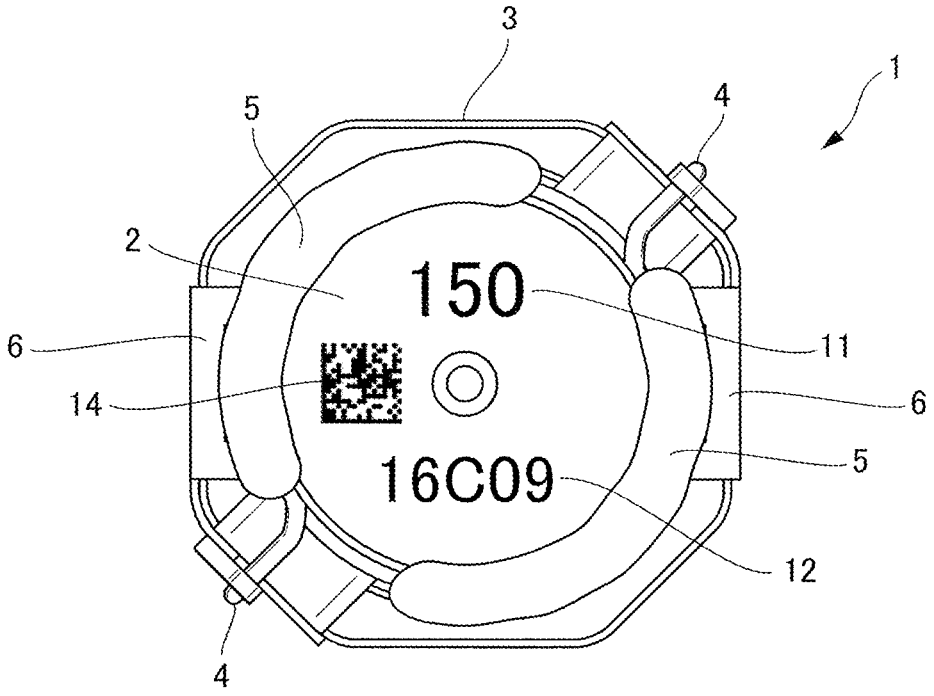
FIG. 1 is a top view of a coil component based on the present invention.

1 Coil component
2 Drum core
3 Sleeve core
4 Winding wire
5 Bonding part
6 Terminal
7 Resin that contains magnetic material
11 Inductance marking
12 Lot number
13 Polarity marking
14, 14*a*, 14*b* Marking area
21, 22 Pot-type core
23, 26 I-type core
25 E-type core
24 Resin board with terminals
101 Drum-core appearance inspection machine
102 Wire-winding machine
103 Sheath separation
104 Sleeve-core appearance inspection machine
105 Terminal-processing machine
106 Assembly-and joining-machine
107 Bonding machine
108 Drying oven
109 Completed-component appearance inspection machine
110 Taping machine
201 Reading means
202 Network
203 Recording means

DETAILED DESCRIPTION OF EMBODIMENTS

The present invention is described in detail below by referring to the drawings as deemed appropriate. It should be noted that these drawings are non-limiting examples and the present invention is not limited to the modes illustrated therein. It should also be noted that characteristic parts of the invention may be emphasized in the drawings and therefore the scale of each part of the drawings is not necessarily accurate.

FIG. 1 is a top view of a coil component 1 used as an example of an electronic component in the first embodiment of the present invention. The coil component 1 based on the present invention comprises multiple members, or specifically a drum core 2, sleeve core 3, winding wire 4, bonding parts 5, and terminals 6. These members each perform functions required of the coil component. For example, the drum core 2 and winding wire 4 generate inductance characteristics, which are a part of the electrical characteristics, of the coil component. For this reason, it is important that the winding wire 4 is wound by the specified number of times and assembled into the drum core 2 in the specified location. Similarly, the sleeve core 3 affects inductance characteristics, bonding parts 5 affect mechanical strength, and terminals 6 affect ease of mounting, of the coil component. It should also be noted that the foregoing are representative properties and those skilled in the art should easily understand that other properties are also affected.

In addition, an inductance marking 11, a lot number 12, and a marking area 14 that provides a marking to be processed digitally, are formed on the top part of the coil component 1, as shown in the figure. The inductance marking 11 indicates the inductance of the coil component 1. For example, the inductance marking 11 may be provided according to the JEITA standard. The lot number 12 indicates the lot of the coil component 1, and may be used to trace the production history of each lot, for example. The marking area 14 is used primarily to record digitalized values. By reading these records using a camera, etc., when necessary, the production records and other information relating to the applicable electronic component can be obtained. In other words, the member data, production records, and other information of each individual electronic component can be traced. It should be noted that, while the information provided by the inductance marking 11 and lot number 12 can also be recorded in the marking area 14, it is marked on the coil component 1 in this example to allow for visual recognition by the user, etc.

Also, the orientation of the electronic component can be identified based on the position of the marking area 14. With the coil component 1, it can also be used to mark the starting position and direction of winding of the winding wire 4. For example, by offsetting the position of the marking area 14 toward the starting side of winding from the center of the exterior flange face of the drum core 2, a polarity marking function can be provided by means of the position of the marking area 14.

Preferably the marking area 14 in FIG. 1 is formed in a manner allowing for a clear marking that prevents misreading of data to be formed. Examples include, but are not limited to, marking with ink by means of ink transfer, inkjet printing, or laser engraving, and other methods. When laser engraving is used, the marking area 14 can be formed at a position recessed from the surface of the member, which provides such benefits as preventing the marking from coming off and suppressing the attachment of contaminants, and consequently misreading of records can be prevented. In addition, preferably the member has small surface irregularities in order to reduce misreading of data. The allowable range of irregularities varies depending on how the marking is formed. If ink is used, the irregularities need only be smaller than the thickness of the ink, and if laser engraving is used, the irregularities need only be smaller than the depth of the engraved recess.

The marking area 14 may show a QR (Quick Response) code or data matrix code, for example, but any other desired two-dimensional code may be shown. A QR code (registered trademark) may be a Model 2 or Micro QR code, but a QR code of any other desired version can also be used. A data matrix code may be of the ECC200 version, but a data matrix code of any other desired version can also be used.

Various standards for two-dimensional codes are available and, although any standard may be selected according to the component size and required amount of data, a standard that supports a greater amount of information per area is desired. Examples of the number of characters recorded in the two-dimensional code in the marking area 14 include 16, 18, 20, 22, 24, 26, 32, 36, 40, and 44. As an example, 16 characters' worth of information may be recorded. For the specification of the two-dimensional code, an optimal size can be set in consideration of the printing space on the product. If a data matrix code is marked on a 10-mm coil component, for example, it can have a size of 16 cells×16 cells (1.6 mm×1.6 mm) based on 0.1 mm per cell. In this case, data corresponding to 16 alphanumeric characters can be recorded.

Now, examples of the marking area 14 to be digitally processed, as proposed by the present invention, are described. As an example, assume that the 16 characters include two digits for the product code, two digits for the last two digits of the year, one digit for the month, and two digits for the day; in this case, numbers corresponding to up to 100 million components produced a day can be stored in the remaining nine digits of values. Hence, a desired number of characters can be selected according to the required amount of information including the production history, lot, production scale (volume) and other information stored in the marking area 14. Here, representative items can be recorded so long as there are at least 16 characters, given the functions required of the respective members of the electronic component. This way, the minimum required quantity of unique numbers can be ensured in order to assign a number to each individual component. If more numbers are required, the number of characters can be increased, and 16 is the minimum number of characters being anticipated. Also, members that cannot be visually discriminated can be discriminated using the marking area 14. For example, members of different shapes may not be discriminated based just on appearance, if they are designed with the same outer diameter and differ only in inner diameter. Even in this case, the present invention allows them to be discriminated using the marking area 14. Another general situation is that some electronic components of the same appearance and same shape may be made of different materials, such as ferrite powder and alloy powder, and thus exhibit different electrical characteristics; however, the present invention allows them to be discriminated using the marking area 14.

Figure 2:
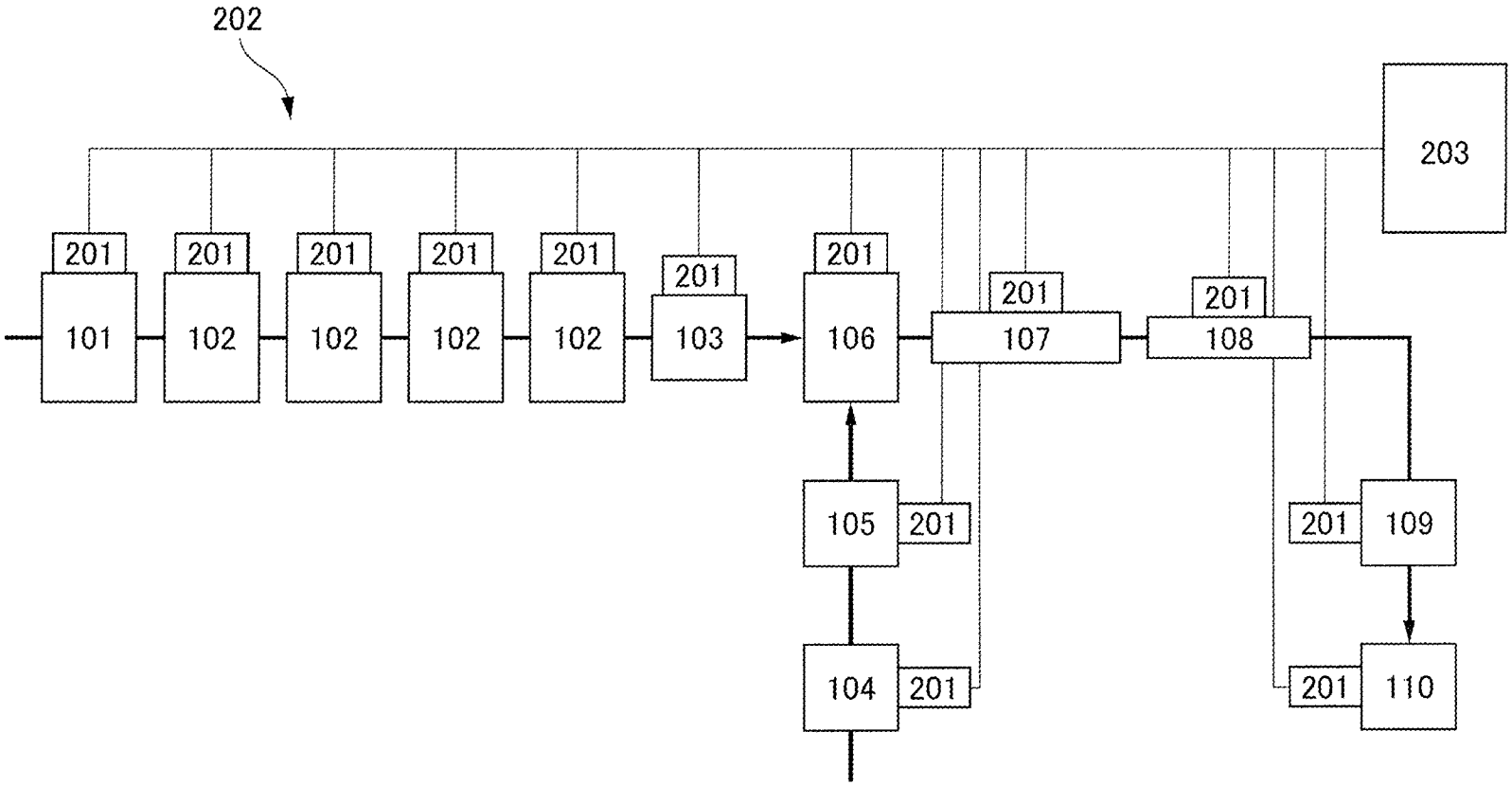
FIG. 2 is a schematic diagram of an apparatus for manufacturing the coil component based on the present invention.
Figure 3:
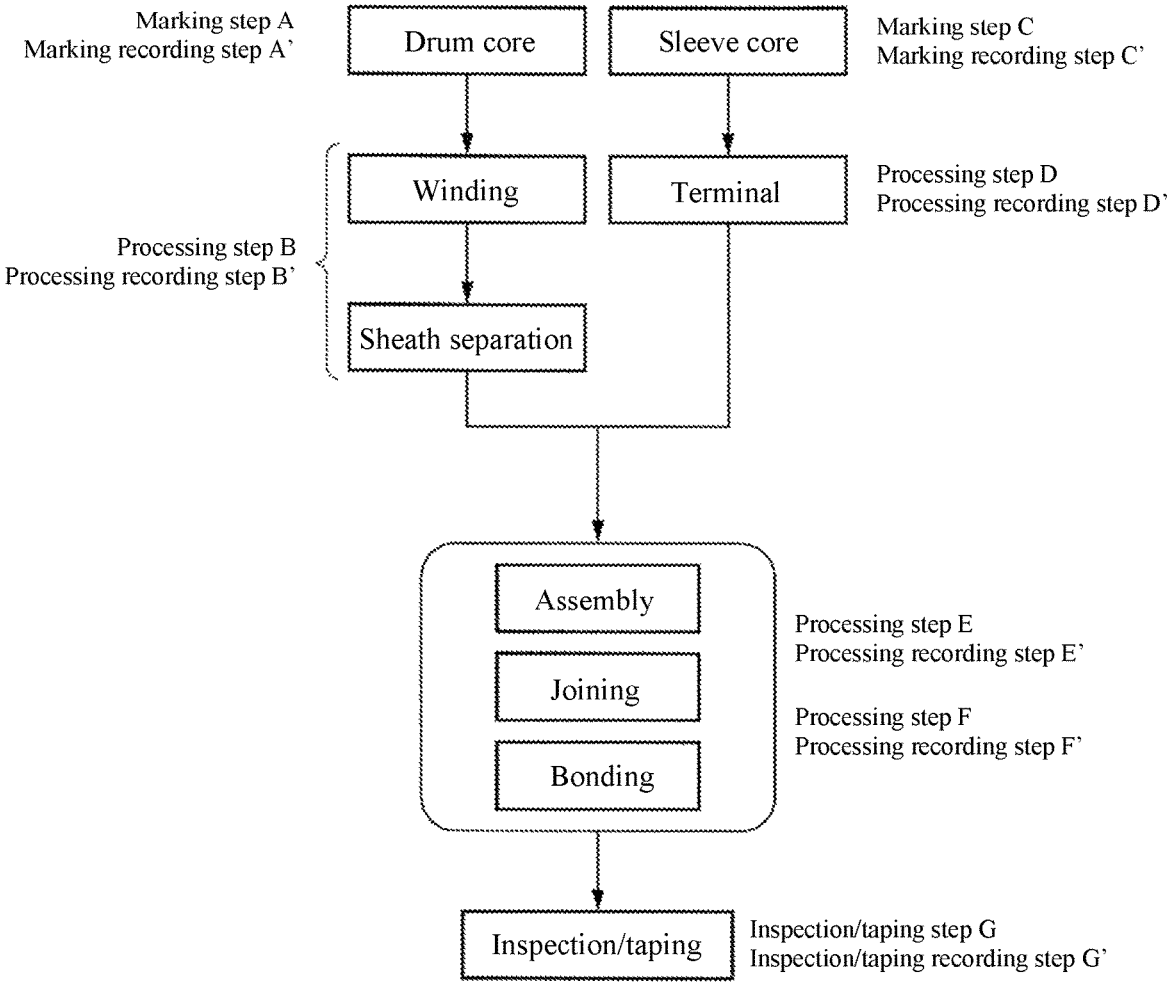
FIG. 3 is a process chart of a method for manufacturing the coil component based on the present invention.

FIG. 2 is a schematic diagram describing an apparatus for manufacturing the coil component 1. FIG. 3 is a process chart describing a method for manufacturing the coil component 1. A drum core 2 is introduced to a drum-core appearance inspection machine 101 to obtain the member data of the several parts of the drum core 2 affecting the performance of the coil component, such as the external dimensions, shaft dimension, flange dimensions and appearance, and the obtained member data is recorded in a recording means 203 via a network 202. Also, a marking area 14*a* to be digitally processed (refer to FIGS. 4A, 4B), which corresponds to the respective member data recorded earlier, is provided on the exterior flange face of the drum core 2. The marking area 14*a* is provided on each member to allow for tracing of the recorded member data. Also, the inductance marking 11 and lot number marking 12 may be formed at the same time. The marking area 14*a* is formed by means of laser engraving on the member surface. This step represents marking step A for forming the marking area 14*a*.

Next, a winding wire 4 is formed using a wire-winding machine 102 by winding a sheathed conductive wire around the drum core 2 on which the marking area 14*a* has been formed. Next, the sheath is separated at both ends of the winding wire 4 using a sheath separation machine 103. Also, the shape of the conductive wire is corrected at the parts where the sheath was separated, which is called forming. Here, assembly data of the several parts affecting the performance of the coil component, such as the dimension data of the winding wire 4 relative to the drum core 2, the sheath separation positions, etc., is obtained, and this data is recorded in a similar manner. This step constituted by winding and sheath separation is where the winding wire 4 is assembled onto the surface of the drum core 2, and represents processing step B for forming the winding wire 4.

On the other hand, a sleeve core 3 is introduced to a sleeve-core appearance inspection machine 104 to obtain the member data of the several parts of the sleeve core 3 affecting the performance of the coil component, such as the external dimensions, inner diameter dimension, height dimension and appearance, and the obtained member data is recorded in the recording means 203 via the network 202. Also, a marking area 14*b* to be digitally processed (refer to FIGS. 4C, 4D), which corresponds to the respective member data recorded earlier, is provided on one outer periphery face of the sleeve core 3. The marking area 14*b* is formed by means of laser engraving on the member surface. This step represents marking step C for forming the marking area 14*b*.

Next, terminals 6 are formed by assembling metal plates onto the sleeve core 3 on which the marking area 14*b* has been formed, using a terminal-processing machine 105. Here, the dimension data of the positions of the metal plates which will function as terminals, relative to the sleeve core 3, is obtained as assembly data, and this data is recorded in a similar manner. This step in which the metal plates are processed represents processing step D for forming the terminals 6.

Next, the drum core 2 and sleeve core 3, on which the marking areas 14*a*, 14*b* have been formed, respectively, are put through an assembly-and-joining machine 106, where the sleeve core 3 is assembled onto the drum core 2 and the two are joined and bonded accordingly. Both ends of the conductive wire constituting the winding wire 4, from which the sheath was separated, are joined to the respective terminals 6. The joining is performed using a laser, with parts of the conductive wires melted and electrically joined to the terminals 6. This step represents processing step E for joining. Next, bonding parts 5 are formed by a bonding machine 107 that applies adhesive onto the drum core 2 and sleeve core 3 while positioning the drum core 2 and sleeve core 3. Bonding parts 5, which are provided by means of applying adhesive using a dispenser, may fix parts of the terminals 6. Next, the adhesive is cured in a drying oven 108. The coil component 1 is now complete. Here, the dimension data of the position of the sleeve core 3 relative to the drum core 2, the joining position, and the adhesive positions, are obtained as assembly data, and this data is recorded in a similar manner. This step represents processing step F for forming the bonding parts 5.

Next, the appearance, characteristics, etc., of the completed component are inspected using a completed-component appearance inspection machine 109, and the completed components are taped together using a taping machine 110. A lot number is assigned to each tape, and this data is recorded in a similar manner. This step represents inspection/taping step G.

In each of steps A to G described above, the marking area 14*a* provided on the drum core 2 or marking area 14*b* provided on the sleeve core 3 is read by the reading means 201, associated with the processing conditions in each step, member data in each step, and assembly data in each step, and recorded in the recording means 203 via the network 202. The reading means 201 may be a camera, for example, which is capable of reading the marking area 14*a*, while the recording means 203 may be a data server, for example, which is capable of recording and storing the data. This recording step is called differently for steps A to G, as marking recording step A', processing recording step B', marking recording step C', processing recording step D', processing recording step E', processing recording step F', and inspection/taping recording step G', respectively.

In marking recording step A', the member data of the drum core 2 such as the external dimensions, axis dimensions, flange dimensions and appearance, and inspection conditions, etc., used for the appearance inspection machine 101, are recorded in association with the data that identifies each individual drum core 2. In processing recording step B', the data for identifying the wire-winding machine actually used for processing from among multiple wire-winding machines 102, the tension value, winding spindle speed, and other processing conditions used for the wire-winding machine 102, the processing conditions used for the sheath separation machine 103, and the assembly data including the dimension data of the winding and sheath separation positions relative to the drum core 2, are recorded in association with the data that identifies each individual drum core 2. In marking recording step C', the member data of the sleeve core 3 such as the external dimensions, inner diameter dimension, height dimension and appearance, and inspection conditions, etc., used for the sleeve-core appearance inspection machine 104, are recorded in association with the data that identifies each individual sleeve core 3. In processing recording step D', the assembly data including the dimension data of the terminal 6 positions relative to the sleeve core 3, and the processing conditions, etc., used for the terminal-processing machine 105, are recorded in association with the data that identifies each individual sleeve core 3. In processing recording step E', the processing conditions, etc., used for the assembly-and-joining machine 106 are recorded in association with the data that identifies each individual drum core 2 and data that identifies each individual sleeve core 3. In processing recording step F', the assembly data including the dimension data of the sleeve core 3 position relative to the drum core 2, joining position and adhesive positions, the adhesive application amount, dispense pressure and other processing conditions used for the adhesive application machine 107, and the drying oven temperature and other processing conditions, etc., used for the drying oven 108, are recorded in association with the data that identifies each individual drum core 2 and data that identifies each individual sleeve core 3. In inspection/taping recording step G', the information that identifies the electronic component including individual members, the lot number assigned to the taping including individual components, etc., are recorded in association with the data that identifies each individual drum core 2 and data that identifies each individual sleeve core 3.

According to the electronic component in the first embodiment of the present invention and the method for manufacturing the electronic component, other processing conditions, member data, and assembly data including, but not limited to, the image picture/threshold, laser power, robot speed, motor speed, sensor threshold, operator, time of work, types of materials, and blending ratio of each material, may be recorded in the marking areas 14*a*, 14*b*, as necessary. Also, these processing conditions, member data, and assembly data may be recorded in the marking areas 14*a*, 14*b*, or recording means 203, or both, in association with the data that identifies each individual member. In addition, some of these processing conditions, member data, and assembly data may be recorded in one of the marking areas 14*a*, 14*b* and recording means 203, and the remainder may be recorded in the other.

As for the electronic component in the first embodiment of the present invention and the method for manufacturing the electronic component, a method for manufacturing an electronic component that includes two members with marking, is described as a representative example; however, the electronic component may include only one member with marking or three or more members with marking, or a marking area may be formed on all of the members constituting the electronic component. In this case, a marking step for forming a marking area is set, as deemed appropriate, after the member data of the applicable member with marking area is obtained.

As described above, the electronic component in the first embodiment of the present invention and the method for manufacturing the electronic component are such that an each individual electronic component can be recorded in association with the processing conditions and other production history of the component. In general, electronic components produced according to the same composition and having the same shape may exhibit different electrical characteristics, such as magnetic permeabilities, according to the heat treatment or other processing conditions, for example. Also, generally, electronic components produced using the same groups of materials and having the same shape may exhibit different electrical characteristics depending on the blending ratios of materials. In addition, generally, electronic components of the same appearance and same shape may be made of different materials, such as ferrite powder and alloy powder, and thus exhibit different electrical characteristics. With the electronic component based on the present invention, these heat treatment conditions, types of materials, blending ratios of materials, and other processing conditions can be recorded. This allows for selection of materials offering optimal electrical characteristics, or changing of processing conditions based on the electronic characteristics of the final product, among others, to improve the production steps.

In another example of the electronic component in the first embodiment of the present invention, if a product incorporating an electronic component based on the present invention is found defective, then the user or customer center takes an image of the component with marking areas based on the present invention and this image is sent to the manufacturer of the component by means of email, etc., for example. The manufacturer can then read the marking areas from the received image. In yet another embodiment, a product incorporating a defective electronic component based on the present invention is directly sent to the manufacturer of the component so that the manufacturer can read the marking areas of the component. Next, each individual electronic component is identified based on the information that has been read from the marking areas, so that the production history of the component can be traced and the processing conditions under which the defect occurred, or other relevant information, can be gathered. In addition, other electronic components having the same production history can be identified and the products containing these electronic components can be recalled or placed under other actions. While prior art necessitated that product recall or other actions be taken in units of production lots, the present invention allows for product recall or other actions to be taken only to a limited extent, which presents economic benefits. Furthermore, the production steps can also be improved based on such information relating to production history.

In yet another mode, the member data of the drum core 2 and that of the sleeve core 3 may be used to select a combination of member data that would achieve desired characteristics of the coil component 1. With this method, for example, members may be combined according to the member dimensions, so that the assembled component will have higher precision.

Figure 4D:
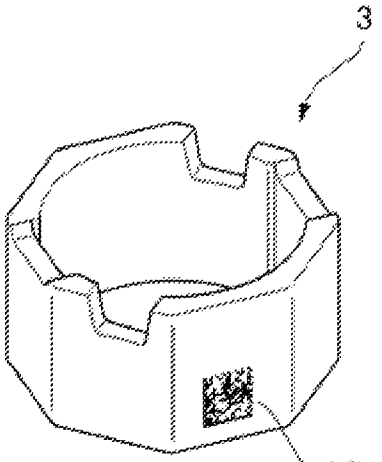
FIGS. 4A to 4D are schematic drawings showing the members constituting the coil component based on the present invention.
Figure 4C:
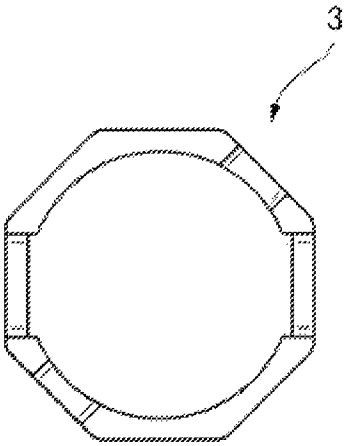
Figure 4B:
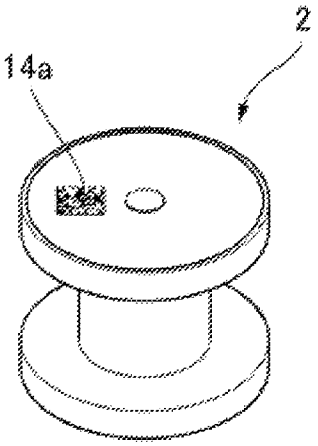
Figure 4A:
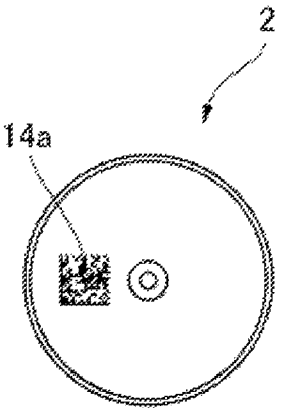

FIGS. 4A to 4D show an example of an electronic component in the second embodiment of the present invention. The drum core 2 and sleeve core 3, which are members constituting the coil component 1 in FIG. 1, are schematically illustrated. FIG. 4A is a top view of the drum core 2. FIG. 4B is a perspective view of the drum core 2. FIG. 4C is a top view of the sleeve core 3. FIG. 4D is a perspective view of the sleeve core 3. A marking area 14*a* is provided on the top face of the drum core 2, while a marking area 14*b* is provided on a side face of the sleeve core 3. In these marking areas 14*a*, 14*b*, the member data of the drum core 2 and that of the sleeve core 3 are recorded, respectively. As described, the multiple members are each provided with a marking area that identifies the applicable member, and each such marking area is provided on a different face, and therefore mix-up of the members does not occur. As for the drum core 2, its marking area 14*a* is provided not at the center of the flange, but at a position closer to the outer periphery, on the exterior flange face of the drum core 2, as shown in FIG. 4A. This way, the marking area can also serve as a polarity marking, in addition to providing the aforementioned functions. In FIGS. 4A to 4D, neither the marking for the characteristics of the coil component, nor the lot number, is indicated; however, these markings may be provided to allow for visual recognition by the user, etc., in the same manner as in FIG. 1.

Figure 5A:
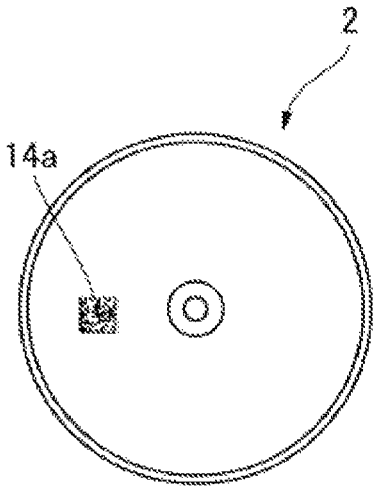
FIGS. 5A and 5B are schematic drawings showing the members constituting the coil component based on the present invention.
Figure 5B:
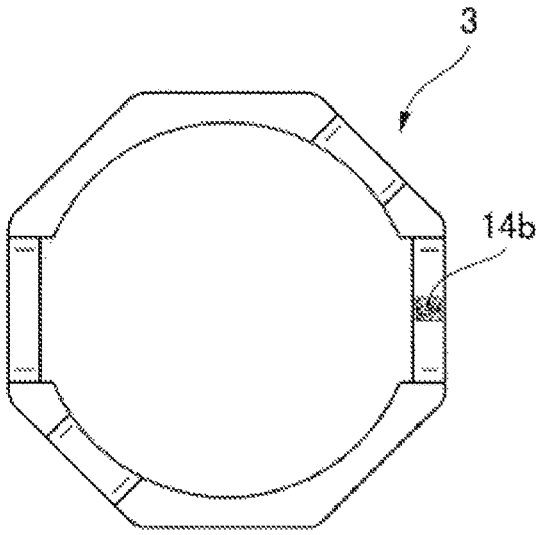

FIGS. 5A and 5B show an example of an electronic component in the second embodiment of the present invention. The drum core 2 and sleeve core 3, which are members constituting the coil component 1 in FIG. 1, are schematically illustrated. FIG. 5A is a top view of the drum core 2. FIG. 5B is a top view of the sleeve core 3. A marking area 14*a* is provided on the top face of the drum core 2, while a marking area 14*b* is provided on the top face of the sleeve core 3. In these marking areas 14*a*, 14*b*, the member data of the drum core 2 and that of the sleeve core 3 are recorded, respectively. In this embodiment, the marking area 14*b* provided on the top face of the sleeve core 3 is smaller than the marking area 14*a* provided on the top face of the drum core 2. As described, the multiple members are each provided with a marking area that identifies the applicable member, and each such marking area has a different size, and therefore mix-up of the members does not occur. In FIGS. 5A and 5B, neither the marking for the characteristics of the coil component, nor the lot number, is indicated; however, these markings may be provided to allow for visual recognition by the user, etc., in the same manner as in FIG. 1.

Figure 6A:
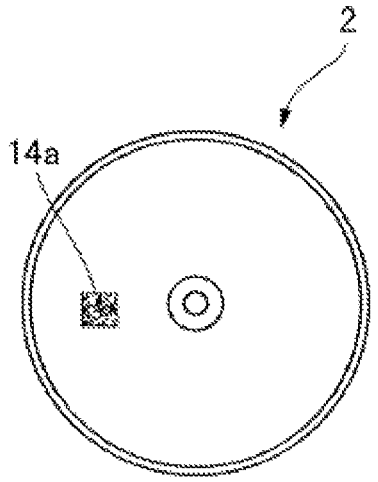
FIGS. 6A and 6B are schematic drawings showing the members constituting the coil component based on the present invention.
Figure 6B:
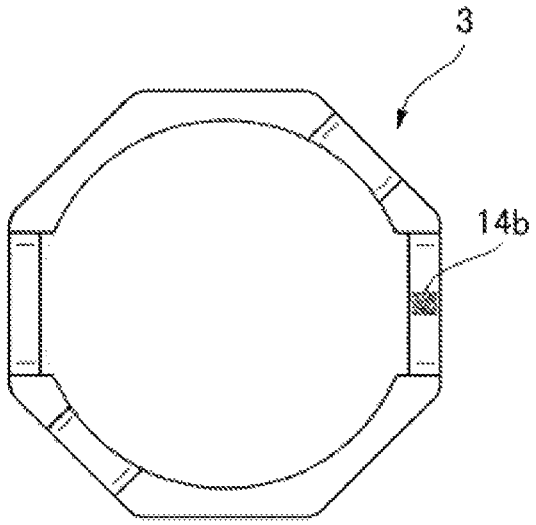

FIGS. 6A and 6B show an example of an electronic component in the second embodiment of the present invention. The drum core 2 and sleeve core 3, which are members constituting the coil component 1 in FIG. 1, are schematically illustrated. FIG. 6A is a top view of the drum core 2. FIG. 6B is a top view of the sleeve core 3. A marking area 14*a* is provided on the top face of the drum core 2, while a marking area 14*b* is provided on the top face of the sleeve core 3. In these marking areas 14*a*, 14*b*, the member data of the drum core 2 and that of the sleeve core 3 are recorded, respectively. In this embodiment, the marking area 14*a* provided on the top face of the drum core 2, and the marking area 14*b* provided on the top face of the sleeve core 3, conform to different standards. As described, the multiple members are each provided with a marking area that identifies the applicable member, and each such marking area has a two-dimensional code conforming to a different standard, and therefore mix-up of the members does not occur. In FIGS. 6A and 6B, neither the marking for the characteristics of the coil component, nor the lot number, is indicated; however, these markings may be provided to allow for visual recognition by the user, etc., in the same manner as in FIG. 1.

Figure 7:
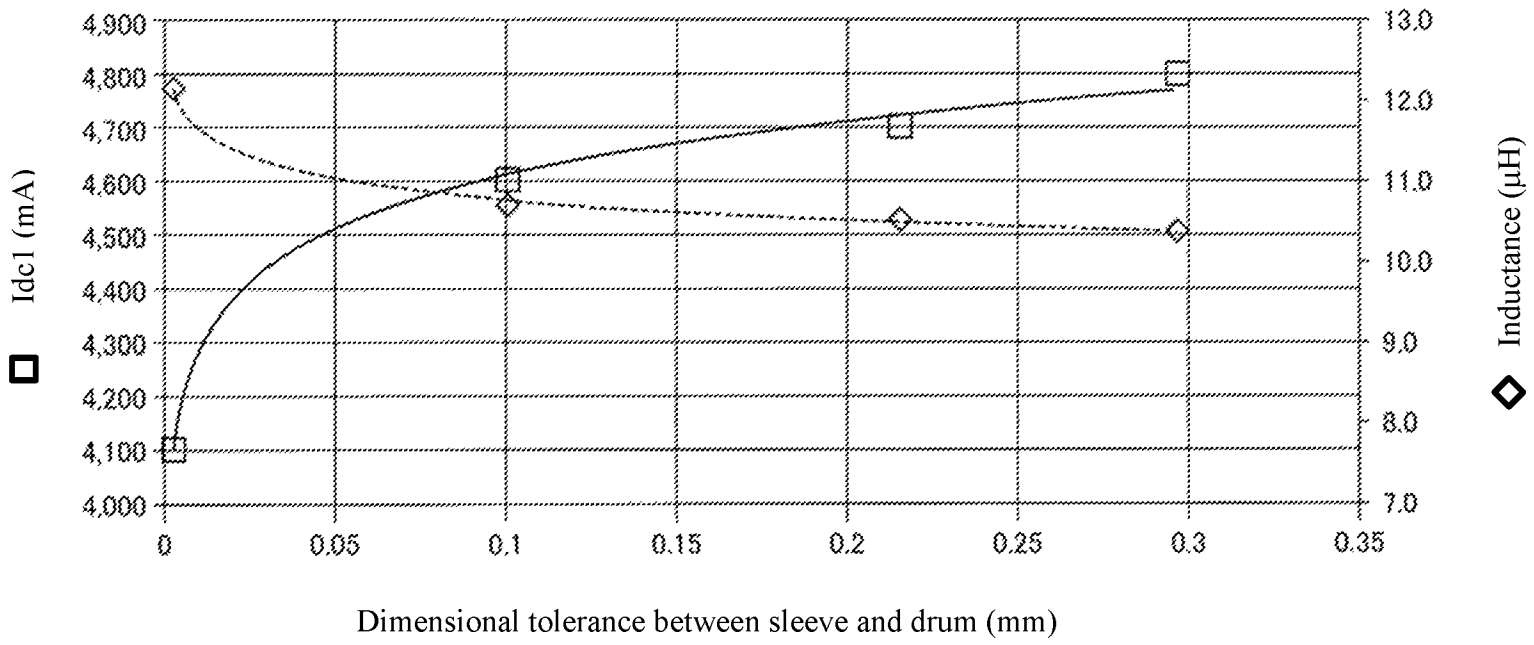
FIG. 7 is a graph illustrating the correlation between the dimensional tolerance and electrical characteristics of the coil component.

Generally, the inductance, superimposition characteristics (Ldcl) and other electrical characteristics of a coil component change as the dimensional tolerance generated between the outer diameter of the drum core and the inner diameter of the sleeve core, where the drum core and sleeve core constitute the coil component, changes. FIG. 7 is a graph illustrating the correlation between the dimensional tolerance and electrical characteristics of such coil component. In the example shown in FIG. 7, as the dimensional tolerance increases, the superimposition characteristics rise and the inductance decreases. This means that, with a coil component, it is important to adjust the dimensional tolerance in order to obtain desired electrical characteristics. However, producing a coil component exhibiting optimal values was difficult based on prior art, where projected parts of these members were used for positioning purposes.

Figure 8C:
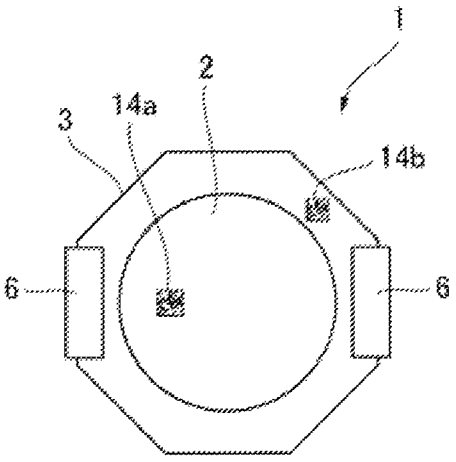
FIGS. 8A to 8C are schematic drawings showing the dimensional tolerance between the coil core and sleeve core constituting the coil component based on the present invention.
Figure 8B:
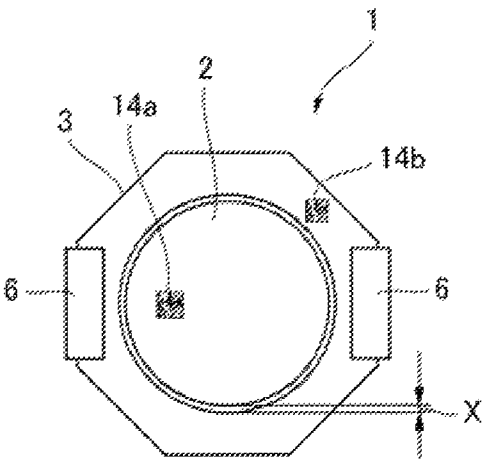
Figure 8A:
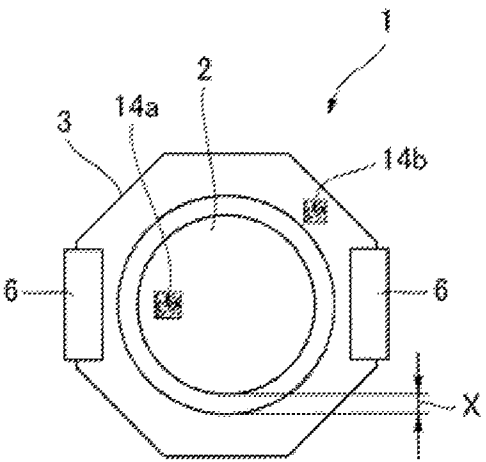

FIGS. 8A to 8C provide schematic drawings showing the dimensional tolerance X between the assembled and joined drum core 2 and sleeve core 3 of the coil component 1 in the second embodiment of the present invention. A marking area 14*a* is provided on the top face of the drum core 2, while a marking area 14*b* is provided on the top face of the sleeve core 3. FIG. 8A shows a condition where the drum core 2 and the sleeve core 3 have the largest dimensional tolerance X. In FIG. 8B, the dimensional tolerance X between the drum core 2 and the sleeve core 3 is smaller than the one shown in FIG. 8A. In FIG. 8C, the drum core 2 and the sleeve core 3 are contacting each other. In the second embodiment of the present invention, the external dimensions of the drum core 2, and the inner diameter dimension of the sleeve core 3, which were both recorded in a step prior to the assembly-and-joining 106 step by means of the member data recorded in the marking areas 14*a*, 14*b* as provided on the drum core 2 and sleeve core 3, respectively, can be referenced. For example, a graph like the one shown in FIG. 7 can be created beforehand, and this graph can be used to easily select a desired combination of member data for producing a coil component 1 that would have desired electrical characteristics, using the member data recorded in the marking areas provided on the members.

As described above, according to the present invention the characteristics data of individual members can be recorded in each step. In addition, the electrical characteristics of the completed coil component 1 can be predicted during the course of manufacturing the coil component 1, which then allows for prediction of the yield, control of the amount of each material to be introduced, as well as improvement of the production plan. As a result, components can be manufactured at a higher yield and cost reduction can be achieved. Also, individual members produced from the same material can be classified based on the markings provided on individual members as well as the size, characteristics and other member data associated with these markings.

Figure 9:
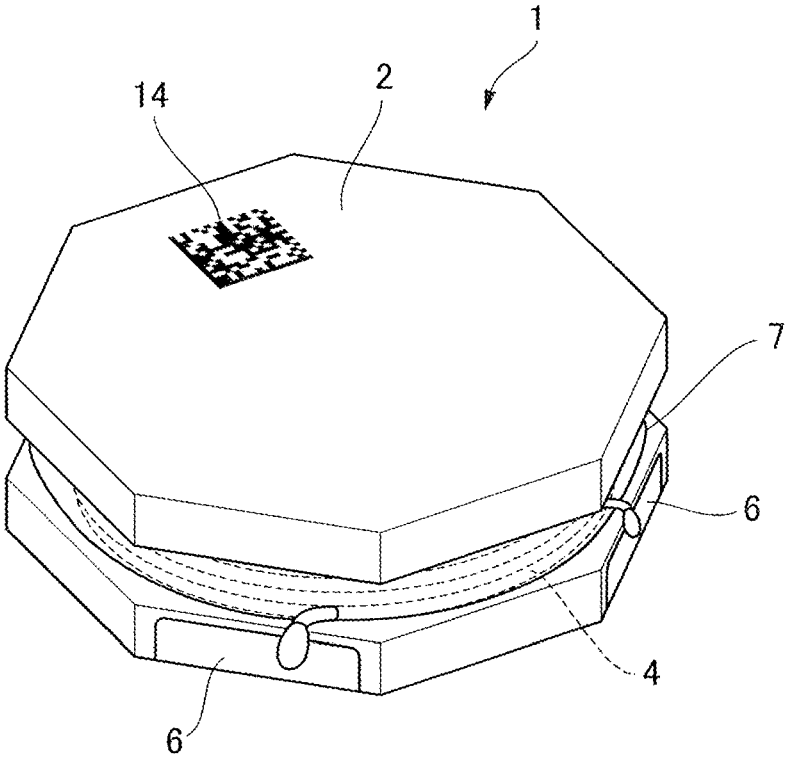
FIG. 9 is a perspective view of the coil component based on the present invention.

FIG. 9 is a perspective view of the coil component 1 used as an example of an electronic component in the third embodiment of the present invention. The coil component 1 based on the present invention is primarily constituted by a drum core 2, a winding wire 4, and a resin 7 that contains magnetic material. The resin 7 that contains magnetic material is filled in a manner covering the winding wire 4 wound around the drum core 2.

In this figure, a marking area 14 is provided, as a marking to be digitally processed, on the top part of the coil component 1. The marking area 14 records the member data of individual members. Also, the orientation of the electronic component can be identified from the position where the marking area 14 is provided. With the coil component 1, the marking area 14 can also be used as a marking for the starting position and direction of winding of the conductor. For example, by offsetting the position of the marking area 14 toward the starting side of winding from the center of the exterior flange face of the drum core 2, a polarity marking function can be added to the two-dimensional code. In FIG. 9, neither the marking for the characteristics of the coil component, nor the lot number, is indicated; however, these markings may be provided to allow for visual recognition by the user, etc., in the same manner as in FIG. 1.

Figure 10:
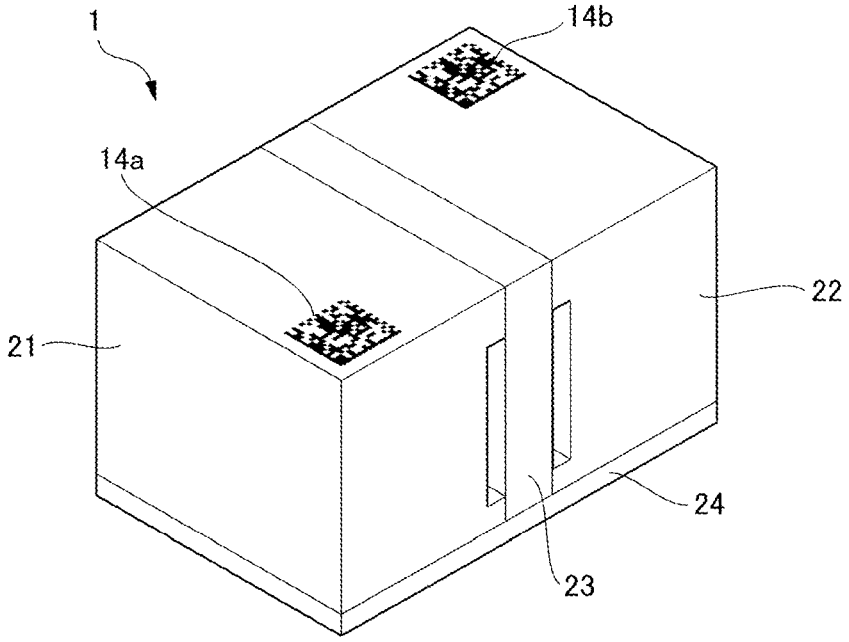
FIG. 10 is a perspective view of the coil component based on the present invention.
Figure 11:
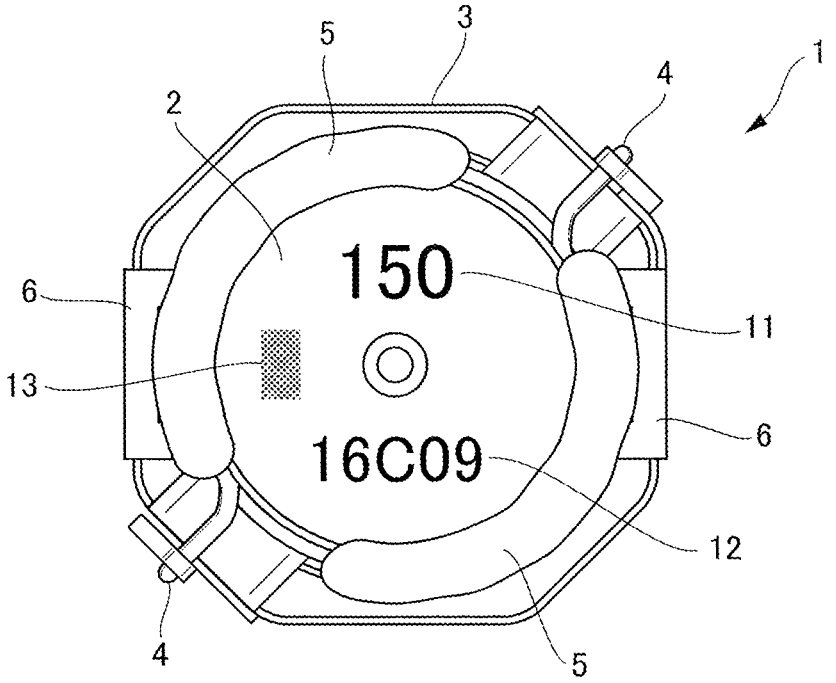
FIG. 11 is a top view of a coil component based on prior art.
Figure 12:
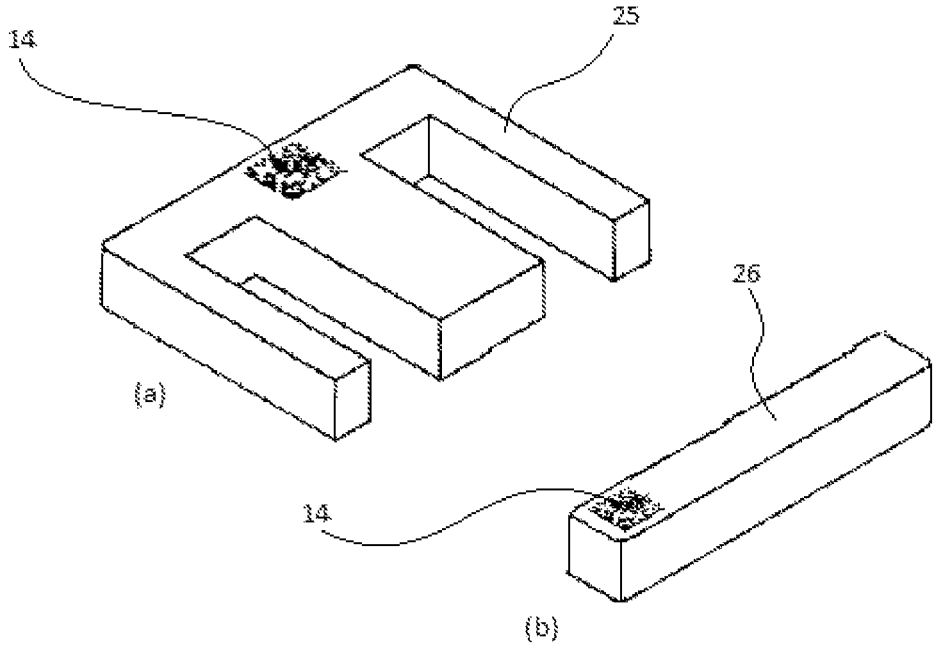
FIG. 12 is a perspective view of (a) an E-type core and (b) an I-type core based on the present invention.

FIG. 10 is a perspective view of the coil component 1 used as an example of an electronic component in the fourth embodiment of the present invention. The coil component 1 based on the present invention is primarily constituted by pot-type cores 21, 22, an I-type core 23, a resin board with terminals 24, and two coils, wherein the I-type core 23 is sandwiched between the pot-type cores 21, 22 which have openings facing sides of the I-type core 23 opposing to each other. In this figure, a marking area 14*a* is provided on the pot-type core 21, while a marking area 14*b* is provided on the pot-type core 22; however, this is only an example and the marking areas 14*a*, 14*b* may be provided on other members. As other non-limiting examples, the marking areas 14*a*, 14*b* may be provided on a combination of the pot-type core 21 and I-type core 23, of the pot-type core 22 and I-type core 23, and of the I-type core 23 and resin board with terminals 24. In other embodiments, three marking areas may be provided, one each on the pot-type core 21, pot-type core 22 and resin board with terminals 24, or marking areas may be provided on more members. Further, an E-type core 25 and/or an I-type core 26 illustrated in FIG. 12 can also be used for providing the marking areas 14 alone or in combination with other core(s) (e.g., a pot-type core) and/or coil(s). In other embodiments, marking areas may be provided on all members. In other embodiments, a marking area may be provided on only one of the members constituting the coil component 1. Whatever the case may be, as shown in FIG. 2 described above, the member data, assembly data and processing conditions pertaining to each member are recorded in association with the marking area provided on the member, and a combination of member data that would achieve desired characteristics of the coil component 1 can be selected using the member data of the members on which the marking areas are provided. This way, a component offering higher precision can be assembled by combining members according to the member dimensions.

Although the aforementioned embodiments use a coil component as an example, the present invention is not limited to a coil component and it may be applied to any electronic component that can be produced by combining multiple members, such as a capacitor or a composite component combining a capacitor, a resistor and a coil. In particular, a passive electronic component is preferred because the function of the component is generated by combining multiple members.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. An electronic component comprised of:

a first member having multiple faces, one of which has first exposed marking configured directly thereon wherein the first exposed marking is digitally processable and first information extracted from an exterior of the first member; and a second member having multiple faces, one of which has second exposed marking configured directly thereon wherein the second exposed marking is digitally processable and contains second information extracted from an exterior of the second member, wherein the first information and the second information define a variable whose value falls within a predetermined range so as to desirably assemble the first member and the second member.

2. An electronic component according to claim 1, wherein the electronic component contains two or more members with marking.

3. An electronic component according to claim 2, wherein marking areas of the two or more members with marking are each provided on surfaces facing a same direction.

4. An electronic component according to claim 2, wherein marking areas of the two or more members with marking are each provided on surfaces facing different directions.

5. An electronic component according to claim 2, wherein marking areas of the two or more members with marking each have different sizes.

6. An electronic component according to claim 2, wherein marking areas of the two or more members with marking each provide a marking conforming to different standards.

7. An electronic component according to claim 1, wherein at least one of the marking areas is positioned away from a center of a surface of the member on which the marking area is provided.

8. An electronic component according to claim 1, wherein at least one of the marking areas has information equivalent to 16 characters or more.

9. An electronic component according to claim 1, wherein the marking area is marked with a two-dimensional code.

10. An electronic component according to claim 1, wherein at least one of the marking areas is laser-engraved.

11. An electronic component according to claim 1, wherein the marking area contains at least one type of record being member data of the member with marking, assembly data of the member with marking, or processing conditions of the member with marking.

12. An electronic component according to claim 1, wherein the electronic component is a coil component and at least one of the marking areas is provided on a magnetic body.

13. An electronic component according to claim 12, wherein the electronic component is a coil component and the magnetic body on which the marking area is provided is a drum core.

14. An electronic component according to claim 13, wherein the electronic component is a coil component and contains two or more members with marking, and the two or more members with marking are selected from a drum core, a coil, a sleeve core, and a resin that contains magnetic grains.

15. An electronic component according to claim 12, wherein the electronic component is a coil component and the magnetic body on which the marking area is provided is an E-type core, I-type core, and/or pot-type core.

16. An electronic component according to claim 15, wherein the electronic component is a coil component and contains two or more members with marking area, and the two or more members with marking are selected from an E-type core, an I-type core, a pot-type core, a coil, a combined core, and a resin that contains magnetic grains.

* * * * *